US008181847B1

(12) United States Patent
Erdie

(10) Patent No.: US 8,181,847 B1
(45) Date of Patent: May 22, 2012

(54) SHIPPING CONTAINER PROVIDED WITH EXTERNAL LOCKING CLIP

(75) Inventor: Jason S. Erdie, Richfield, OH (US)

(73) Assignee: Erdie End Caps, LLC, Lorain, OH (US)

( * ) Notice: Subject to any disclaimer, the term of this patent is extended or adjusted under 35 U.S.C. 154(b) by 388 days.

(21) Appl. No.: 12/619,331

(22) Filed: Nov. 16, 2009

(51) Int. Cl.
*B65D 3/26* (2006.01)
*B65D 43/04* (2006.01)
*B65D 55/06* (2006.01)

(52) U.S. Cl. ..... 229/102; 229/5.5; 229/5.7; 229/125.17; 229/125.21; 229/125.28; 229/125.37

(58) Field of Classification Search ..... 229/125.17, 229/125.37, 5.5, 5.7, 93, 125.21, 125.28; 220/324, 326, 281, 297, 300, 345.2, 345.3, 220/786–789
See application file for complete search history.

(56) References Cited

U.S. PATENT DOCUMENTS 1,690,853 A * 11/1928 Behrman ..... 229/125.17
2,822,973 A * 2/1958 Armstrong et al. ..... 229/125.21
3,161,345 A * 12/1964 McLeod ..... 229/5.5
3,875,843 A * 4/1975 Maeda et al. ..... 229/125.21
3,913,774 A * 10/1975 Vajtay ..... 220/315
3,954,219 A * 5/1976 Mangini et al. ..... 229/125.22
3,986,659 A * 10/1976 Vajtay ..... 229/125.17
4,071,064 A * 1/1978 Saul ..... 220/324
4,782,977 A * 11/1988 Watanabe et al. ..... 220/324
4,883,193 A * 11/1989 Christensson ..... 220/266
4,927,074 A * 5/1990 LaRue et al. ..... 229/125.21
5,012,941 A * 5/1991 Abrams et al. ..... 215/250
5,730,352 A * 3/1998 Deekes ..... 229/125.17
6,276,528 B1 * 8/2001 Nowotny et al. ..... 206/397
7,296,729 B2 * 11/2007 Erdie ..... 229/125.17
7,296,730 B2 * 11/2007 Erdie ..... 229/125.17
7,581,670 B2 * 9/2009 Erdie ..... 229/5.5
7,581,671 B2 * 9/2009 Erdie ..... 229/5.5
7,909,236 B2 * 3/2011 Erdie ..... 229/125.17
2004/0031807 A1 * 2/2004 Chou ..... 220/786
2005/0161463 A1 * 7/2005 Litchman ..... 220/787
2005/0205649 A1 * 9/2005 Erdie ..... 229/5.5
2007/0095838 A1 * 5/2007 Roesler ..... 220/326
2009/0229092 A1 * 9/2009 Xin ..... 220/324
* cited by examiner

*Primary Examiner* — Gary Elkins
(74) *Attorney, Agent, or Firm* — Rankin, Hill & Clark LLP

(57) ABSTRACT

A shipping container including a container body having at least one open end and at least one mounting opening formed therein adjacent to the open end, an end cap having a sidewall provided with a projection that extends away from the sidewall and a slot; and an external locking clip comprising an elongate member having a first end provided with a protruding portion and a second end provided with a receiving portion for receiving an end portion of the protruding portion. The end cap is received in the open end of the container body such that the container body surrounds the sidewall, the projection extends into the mounting opening, and the mounting opening is aligned with the slot in the sidewall. The protruding portion extends through the mounting opening and the aligned slot, and end portion of the protruding portion is received within the receiving portion.

11 Claims, 5 Drawing Sheets

SHIPPING CONTAINER PROVIDED WITH EXTERNAL LOCKING CLIP

BACKGROUND OF INVENTION

1. Field of Invention

The present invention relates to a shipping container provided with an external locking clip.

2. Description of Related Art

Erdie, U.S. Pub. Pat. App. No. 2005/0205649 A1, which is hereby incorporated by reference in its entirety, discloses a locking mechanism for a shipping container comprising a paper tube and an end cap that is adapted to be received in an open end of the paper tube. The locking mechanism is integrally formed with the end cap and is configured to break when disengaged from a locking position so as to make it evident that the security of the shipping container has been compromised. For this reason, an end cap provided with an integral locking mechanism is single-use device.

BRIEF SUMMARY OF THE INVENTION

In view of the foregoing, the present invention is directed toward a shipping container provided with an external locking clip. The locking clip, which is separate and distinct from an end cap, prevents removal of the end cap from a container body unless and until the locking clip is broken thereby making it evident that the security of the shipping container has been compromised. The use of an external locking clip allows the end cap to be reused.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE INVENTION

Figure 1:
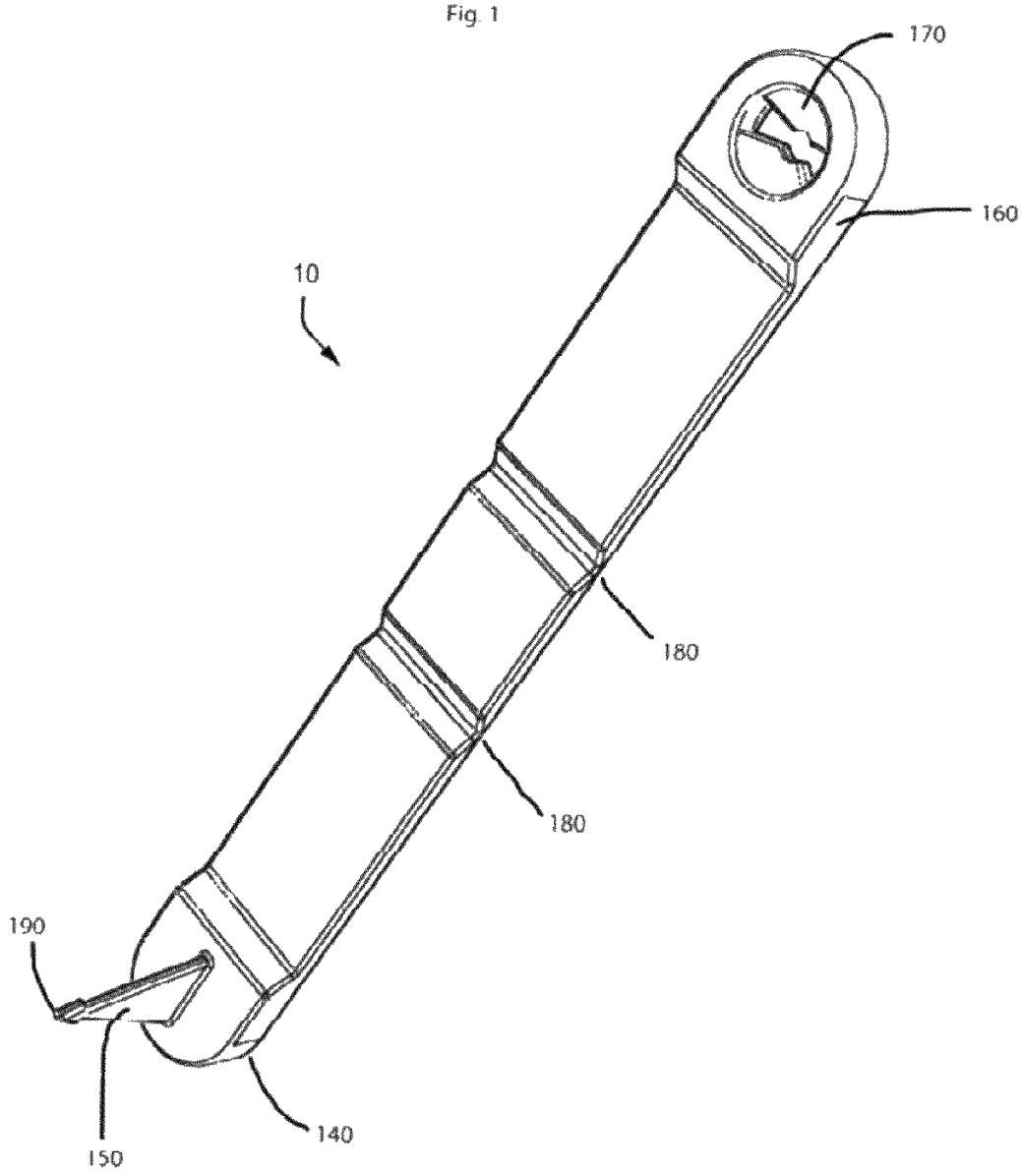
FIG. 1 is a perspective view of an embodiment of a locking clip.
Figure 2:
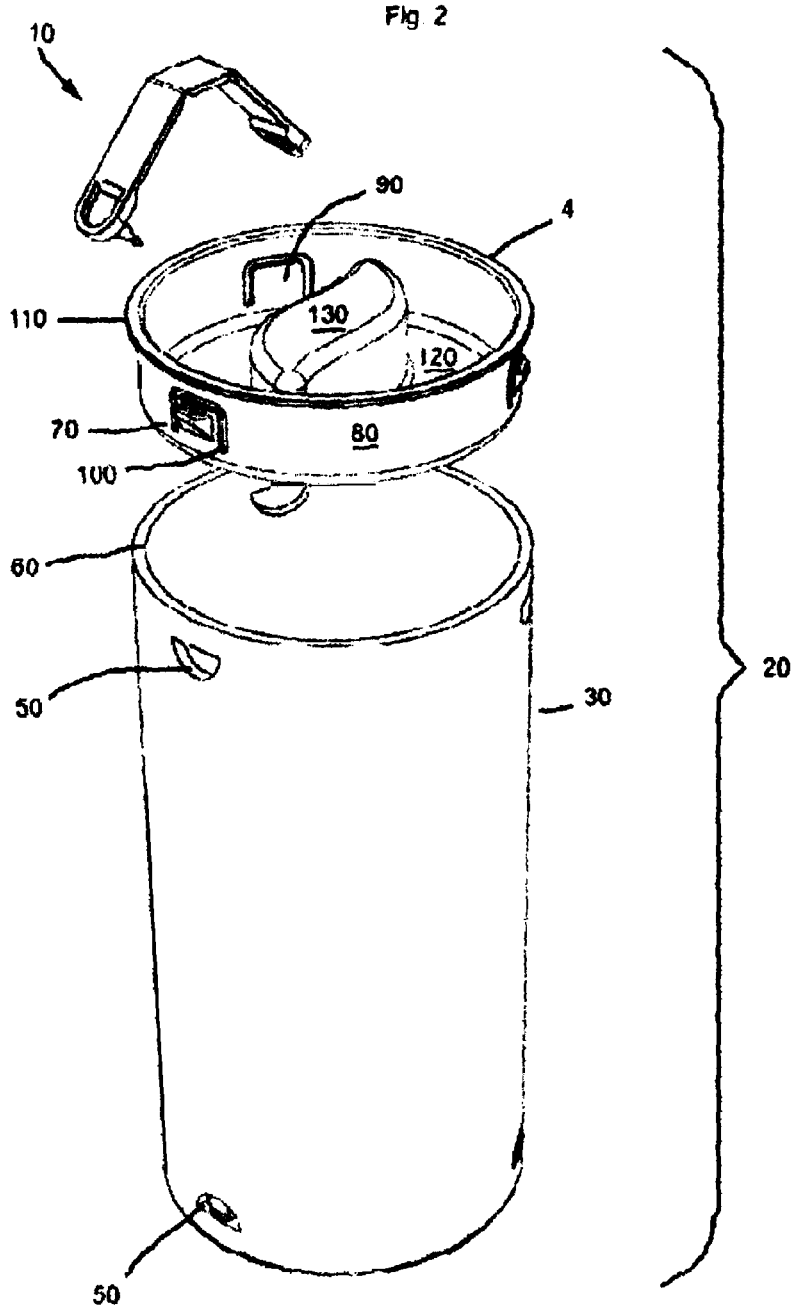
FIG. 2 is an exploded perspective view of the locking clip shown in FIG. 1 together with a shipping container consisting of an end cap and a container body.

With reference to the accompanying drawing figures, and particularly FIGS. 1 and 2, a shipping container 20 according to the invention comprises a container body 30, at least one end cap 40 and an external locking clip 10 for securing the end cap 40 to the container body 30. The word "external" means that the locking clip 10 is separate and distinct from the container body 30 and the end cap 40 and is not integrally formed as part of either.

In accordance with the invention, the container body 30 is provided with at least one mounting opening 50 proximal to an open end 60. The end cap 40 is provided with at least one projection 70 that extends from a sidewall 80 of the end cap 40. The projection 70 is adapted to extend into the mounting opening 50 formed in the container body 30 when the end cap 40 is received within the open end 60 of the container body 30 and the sidewall 80 of the end cap 40 is surrounded thereby. Preferably, a plurality of mounting openings 50 are spaced an equal distance apart about the container body 30 adjacent to the open end 60, and a corresponding plurality of projections 70 extend from the sidewall 80 of the end cap 40.

In the embodiment of the invention shown in FIG. 2, each projection 70 is formed on a deflectable tab portion 90 of the sidewall 80 of the end cap 40. The deflectable tab portion 90 is defined by a slot 100 provided in the sidewall 80 of the end cap 40. In this embodiment of the invention, the slot 100 is aligned with the mounting opening 50 in the container body 30 when the end cap 40 is received within the open end 60 of the container body 30. It will be appreciated that the projections 70 do not necessarily need to be formed on a deflectable tab portion 90 of the sidewall 80, provided a slot or opening is provided through the sidewall 80 of the end cap 40 that aligns with an opening provided in the container body 30 proximal to the open end 60 when the end cap 40 is received within the open end 60 of the container body 30.

The projections 70 preferably have the features as described in Erdie, U.S. Pub. Pat. App. No. 2004/0205648 A1, which is hereby incorporated by reference in its entirety. In particular, the projections 70 preferably include a top edge portion adapted to contact an edge portion of the mounting opening 50 to prevent withdrawal of the end cap 40 from the container body 30 unless and until the projection 70 is deflected inwardly such that the projection 70 is no longer disposed within the mounting opening 50 of the container body 30. The projections 70 further preferably include a bottom ramp portion arranged on a side opposite the top edge portion, which provides a gradual or angled approach from the sidewall 80 to a tip or farthest point of the projection 70. The bottom ramp portion promotes inward deflection of the projection 70 (particularly when the projection 70 is formed on a deflectable tab portion 90) when the end cap 40 is pressed into the open end 40 of the container body 30. Furthermore, the projections 70 preferably further include a side ramp portion that is arranged on either or both sides of the projection 70 between the top edge portion and the bottom ramp portion. Like the bottom ramp portion, the side ramp portion provides a gradual or angled approach from the sidewall 80 to a tip or farthest point of the projection 70.

It will be appreciated that the shape of the projection 70 is not per se critical, and that rounded "bumps" with a generally flat top edge portion or other shapes could be used. It will also be appreciated that the deflectable tab portion 90 and the projection 70 can be coextensive. It is important, however, that the top edge portion of the projection 70 be able to contact the top peripheral edge of the mounting opening 50 to prevent the removal of the end cap 40 from the container body 30, and that the projection 70 be able to be positioned such that it no longer projects into the mounting opening 50.

The end cap 40 also preferably comprises a peripheral rim portion 110 that extends beyond the sidewall 80 and an end wall 120 that extends between the sidewall 80. The end wall 120 can extend between the sidewall 80 at any point (i.e., at the bottom or at the top or at any point in between). In FIG. 2, the end wall 120 extends from a lower or bottom portion of the sidewall 80. Preferably, the end wall 120 further comprises a handle portion 130 for facilitating the insertion of and removal of the end cap 40 from the container body 30. The shape and configuration of the handle portion 130 is not critical, but should provide a comfortable gripping surface for one's fingers.

The end cap 40 is preferably formed of a plastic material such as polystyrene, polyethylene, polypropylene, nylon and/ or one or more other thermoplastic or thermosetting polymers. The end cap can be formed using conventional molding or fabricating processes and equipment.

Figure 3:
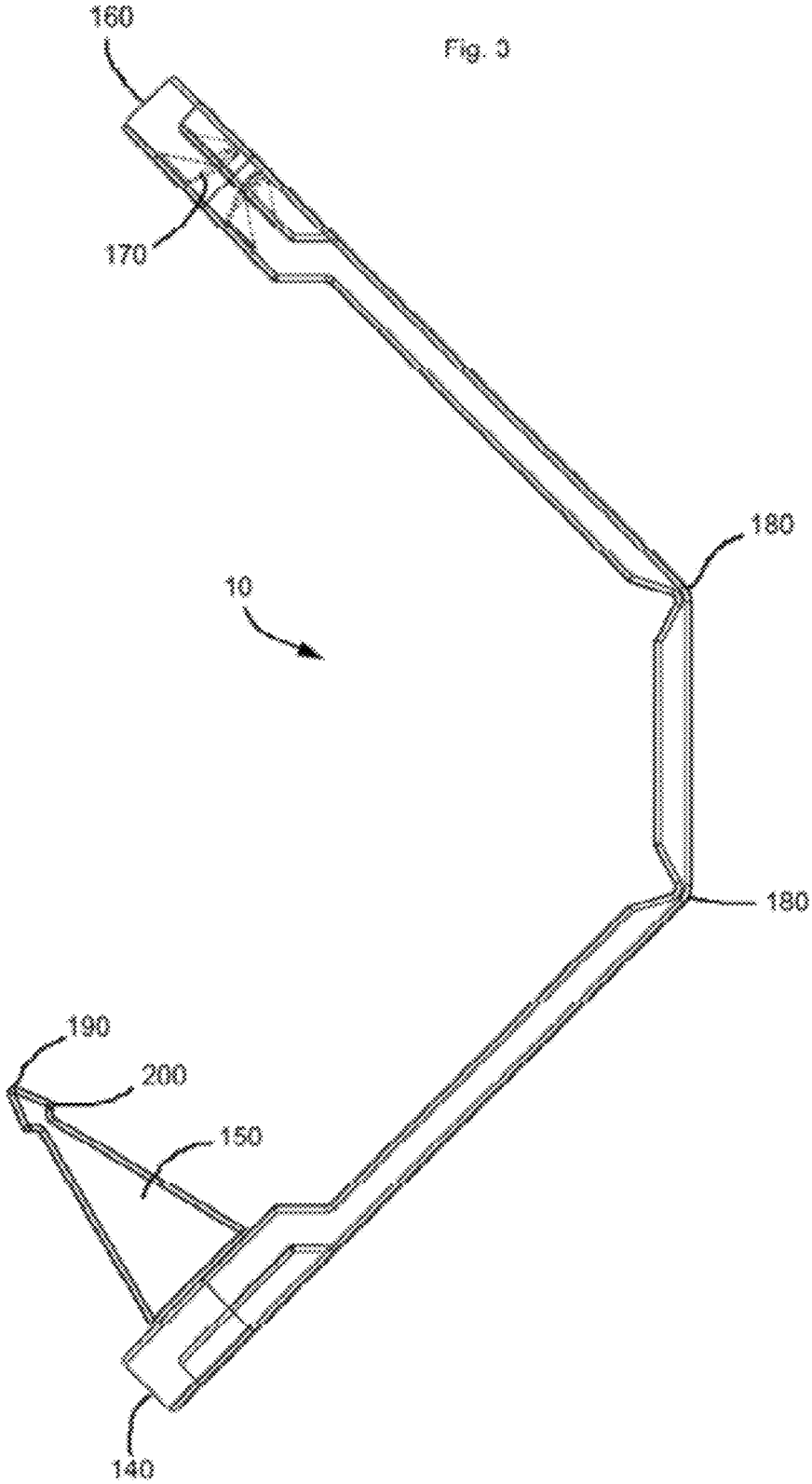
FIG. 3 is side view of the locking clip shown in FIG. 1.
Figure 4:
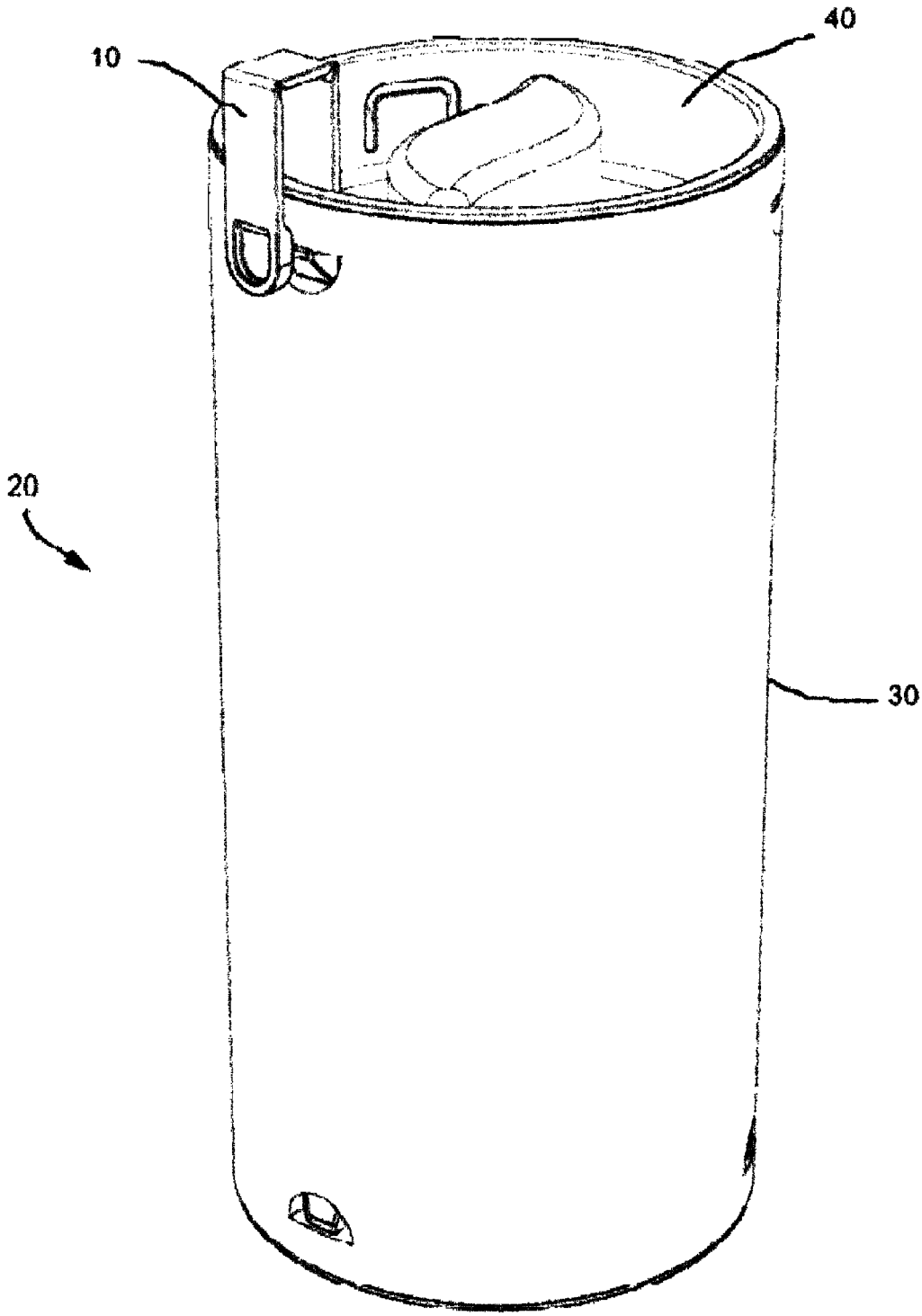
FIG. 4 is the locking clip shown in FIG. 1 in a locked position.

With particular reference to FIGS. 1 and 3, the locking clip 10 is an elongate member having a first end 140 provided with a protruding portion 150 and a second end 160 provided with a receiving portion 170. Preferably, at least one and more preferably two living hinges 180 are disposed intermediate the two ends 140, 160 such that the locking clip 10 can be folded back on itself to allow the end portion 190 of the protruding portion 150 to be received within the receiving portion 170. The end portion 190 is preferably pointed, and includes at least one and more preferably a plurality of barbs 200 inward of the end portion 190.

Figure 5:
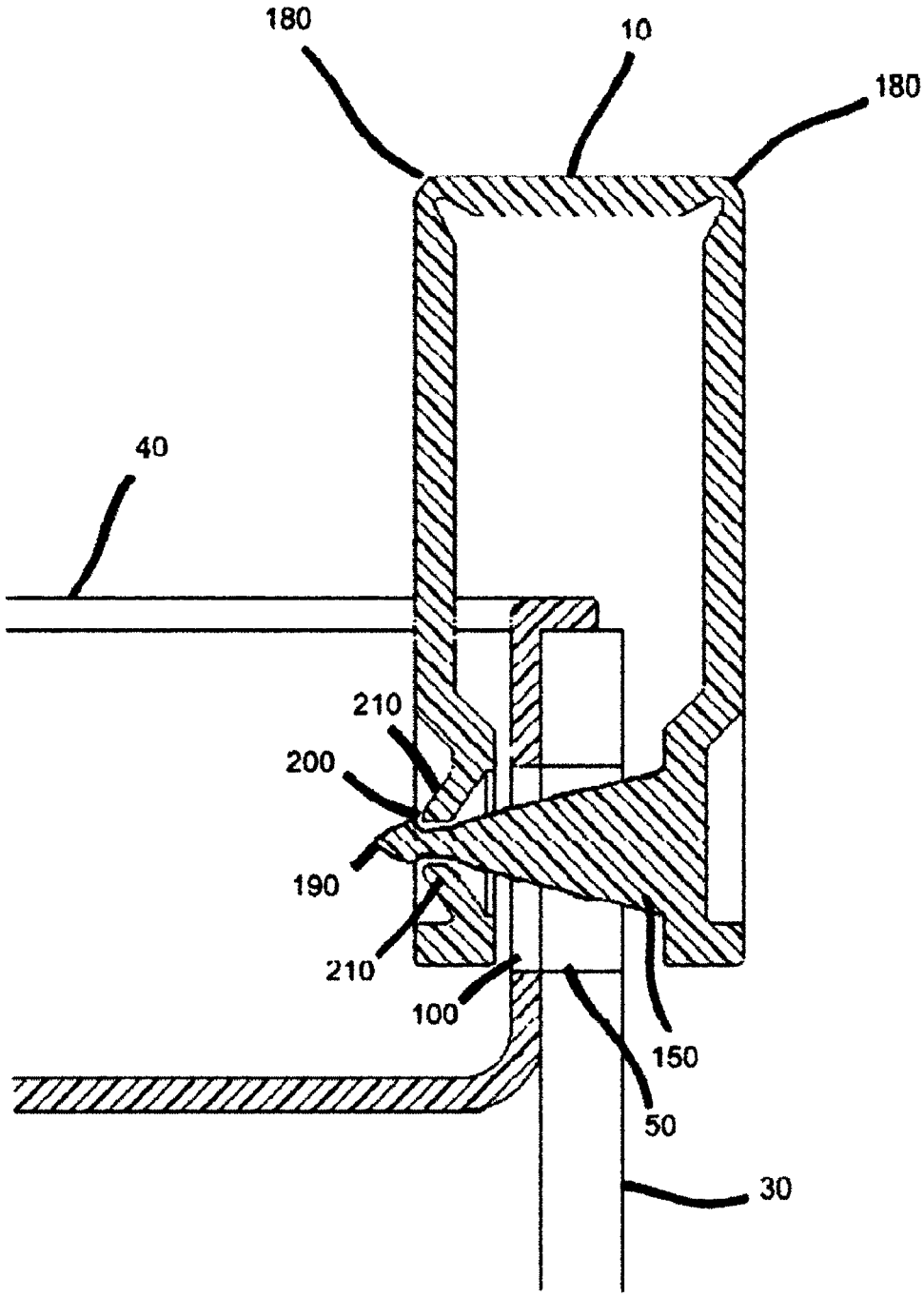
FIG. 5 is a side sectional view taken through the longitudinal axis of the locking clip and a portion of the container body and end cap shown in FIG. 4.

The receiving portion 170, which is best viewed in FIG. 5, includes an opening through which the end portion 190 of the protruding portion 150 can pass. The receiving portion also includes members 210, which are biased so as to allow the end portion 190 of the protruding portion 150 to pass through the opening, but not to allow the barbs 200 to be withdrawn back through the opening without breaking either the receiving portion 170 or the protruding portion 150 (or both) of the locking clip 10.

In use, protruding portion 150 of the locking clip 10 is pushed through the aligned mounting opening 50 of the container body 30 and the slot 100 in the end cap 40, then into the receiving portion 170 of the locking clip 10 until the barbs 200 have passed the members 210. When the locking clip 10 is secured in this manner, the protruding portion 150 of the locking clip 10 maintains the alignment of the mounting opening 50 and the slot 100, and thereby inhibits disengagement of the end cap 40 from the container body 30. The only way the end cap 40 can be removed from the container body 30 is if the locking clip 10 is broken apart. Thus, if anyone other the intended recipient attempts to tamper with the shipping container, the damaged locking clip 10 will readily shows evidence of tampering, thereby providing assurance to the recipient that the package has arrived safely, without theft, vandalism or other loss. To enhance security, the locking clip 10 can be provided with a unique identification and/or tracking number when originally sealed. This unique identification and/or tracking number can further ensure that the shipping container has not been tampered with during transit to the intended recipient.

It will be appreciated that any desired number of locking clips equal to or greater than one can be used to secure the end cap to the container body. Furthermore, it will be appreciated that the aligned slot(s) and the mounting opening(s) need not be located near the projection(s), but could be intermediate thereof. It will further be appreciated that while a rotatable end cap and a circular paper tube such as described in Erdie, U.S. Pub. Pat. App. No. 2004/0205648 A1, are presently most preferred, the external locking clip could be utilized with container bodies and end caps having a different shape in cross-section (e.g., triangles, squares, ovals etc.).

The present invention also provides methods of securing an end cap to a container body. In a first embodiment, the method comprises: (1) providing a container body having at least one open end and at least one mounting opening formed therein adjacent to the open end; (2) providing an end cap having a sidewall provided with at least one projection that extends away from the sidewall and at least one slot; (3) pressing the end cap into the open end of the container body until the container body surrounds the sidewall, the projection extends into the mounting opening and the mounting opening is aligned with the slot in the sidewall; (4) providing an external locking clip comprising an elongate member having a first end provided with a protruding portion and a second end provided with a receiving portion; and (5) extending the protruding portion through the mounting opening and the aligned slot until an end portion of the protruding portion is received within an opening in the receiving portion. Material to be shipped can be placed within the container body before the end cap is secured thereto.

A second embodiment of a method of the invention comprises: (1) providing a shipping container comprising a container body containing shipped matter, an end cap secured to an open end of the container body and an external locking clip securing the end cap to the container body, wherein (a) the end cap includes a sidewall provided with at least one projection that extends away from the sidewall and at least one slot, (b) the end cap is received within the open end of the container body such that the container body surrounds the sidewall, the projection extends into the mounting opening and the mounting opening is aligned with the slot in the sidewall, and (c) the external locking clip comprises an elongate member having a first end provided with a protruding portion and a second end provided with a receiving portion and the protruding portion extends through the mounting opening and the aligned slot with an end portion of the protruding portion being received within an opening in the receiving portion; (2) breaking the locking clip; (3) removing the protruding portion from the mounting opening and aligned slot; (4) removing the end cap from open end of the container body; and (5) removing the shipped matter from the container body. Preferably, the method further comprises reusing the container body and end cap as described in the first embodiment of a method of the invention, utilizing a new locking clip.

The present invention is particularly useful for forming reusable shipping containers. The end caps can be securely attached to the paper tubes quickly and without the need for special tooling, and can be removed with relative ease. The end caps of shipping tubes formed in accordance with the invention are significantly more difficult to unintentionally dislodge from an open end of a paper tube than conventional plastic plugs or other end closures. The locking clip can be attached quickly and easily, and provides a tamper-evident structure for maintaining the security of matter stored within the shipping container during transit. The end cap can be reused. Only the damaged once-used locking clip needs to be replaced.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A shipping container comprising:

a container body having at least one open end and at least one mounting opening formed therein adjacent to the open end;

an end cap having a sidewall provided with at least one projection that extends away from the sidewall and at least one slot; and an external locking clip comprising an elongate member having a first end provided with a protruding portion and a second end provided with a receiving portion provided with an opening for receiving an end portion of the protruding portion;

wherein the end cap is received in the open end of the container body such that the container body surrounds the sidewall, the projection extends into the mounting opening, and the mounting opening is aligned with the slot in the sidewall, wherein the protruding portion extends through the mounting opening and the aligned slot, and wherein the end portion of the protruding portion is received within the opening in the receiving portion.

2. The shipping container according to claim 1 wherein the end portion of the protruding portion can only be withdrawn from the receiving portion by breaking the locking clip.

3. The shipping container according to claim 1 wherein the locking clip is an elongate member further comprising at least one living hinge intermediate the first end and the second end that facilitates folding the locking clip back on itself.

4. The shipping container according to claim 1 wherein the container body is a cylindrical paper tube.

5. The shipping container according to claim 4 wherein the projection extending from the end cap is formed on a deflectable tab portion of the sidewall.

6. The shipping container according to claim 5 wherein the deflectable tab portion of the sidewall is defined at least in part by the slot.

7. The shipping container according to claim 5 wherein the projection includes a top edge portion adapted to contact an edge portion of the mounting opening to prevent withdrawal of the end cap from the container body unless and until the projection is deflected inwardly such that the projection is no longer disposed within the mounting opening of the container body.

8. The shipping container according to claim 7 wherein the projection includes a bottom ramp portion arranged on a side opposite the top edge portion, which provides a gradual approach from the sidewall to a tip of the projection to promote inward deflection of the projection when the end cap is pressed into the open end of the container body.

9. The shipping container according to claim 8 wherein the projection includes a side ramp portion that is arranged on either or both sides of the projection between the top edge portion and the bottom ramp portion.

10. A method for securing matter within a shipping container, the method comprising:

providing a container body having at least one open end and at least one mounting opening formed therein adjacent to the open end;

placing matter within the container body;

providing an end cap having a sidewall provided with at least one projection that extends away from the sidewall and at least one slot;

pressing the end cap into the open end of the container body until the container body surrounds the sidewall, the projection extends into the mounting opening and the mounting opening is aligned with the slot in the sidewall;

providing an external locking clip comprising an elongate member having a first end provided with a protruding portion and a second end provided with a receiving portion provided with an opening for receiving an end portion of the protruding portion; and extending the protruding portion through the mounting opening and the aligned slot until an end portion of the protruding portion is received within the opening in the receiving portion.

11. A method for removing shipped matter from a shipping container comprising a container body containing shipped the matter, an end cap secured to an open end of the container body, and an external locking clip securing the end cap to the container body, wherein the end cap includes a sidewall provided with at least one projection that extends away from the sidewall and at least one slot, the end cap is received within the open end of the container body such that the container body surrounds the sidewall, the projection extends into the mounting opening and the mounting opening is aligned with the slot in the sidewall, and the external locking clip comprises an elongate member having a first end provided with a protruding portion and a second end provided with a receiving portion and the protruding portion extends through the mounting opening and the aligned slot with an end portion of the protruding portion being received within an opening in the receiving portion, the method comprising:

breaking the locking clip;

withdrawing the protruding portion from the mounting opening and aligned slot;

disengaging the end cap from open end of the container body; and removing the shipped matter from the container body.

* * * * *